United States Patent [19]

Pulichino, Jr.

[11] Patent Number: 4,915,220

[45] Date of Patent: Apr. 10, 1990

[54] GARMENT BAG WITH MOUNTING FOR HOOK

[75] Inventor: John V. Pulichino, Jr., Providence, R.I.

[73] Assignee: American Tourister, Inc., Warren, R.I.

[21] Appl. No.: 320,525

[22] Filed: Mar. 8, 1989

[51] Int. Cl.[4] ..... A45C 5/06; A45C 5/12; A45C 13/10; A45C 13/34

[52] U.S. Cl. ..... 206/278; 206/287.1; 190/119; 383/23

[58] Field of Search ..... 206/278, 287, 287.1, 206/292, 293; 190/110, 119; 383/23, 86; 248/339, 359 H, 359 I; 24/265 H, 265 AL, 30.5 R, 698

[56] References Cited

U.S. PATENT DOCUMENTS

D. 281,465 11/1985 Bomes et al. ..... D3/71
4,115,362 4/1938 Freysinger ..... 190/109
4,685,560 8/1987 King ..... 206/287.1
4,693,368 9/1987 King et al. ..... 206/287.1
4,753,342 6/1988 Pulichino, Jr. et al. ..... 206/287.1 X

FOREIGN PATENT DOCUMENTS 368184 3/1932 United Kingdom ..... 206/292

*Primary Examiner*—Sue A. Weaver
*Attorney, Agent, or Firm*—Wood, Herron & Evans

[57] ABSTRACT

A garment bag has a hook at its upper end and a loop at its lower end into which the hook is retained when the garment bag is folded upon itself. The hook is attached to the upper end by means of a slide which can selectively be attached to a rigid receptacle on said upper end or a loop extending from the upper end, thereby providing for one of two dimensions from the upper end to the lower end, thereby accommodating either lightly filled or very full garment bags.

3 Claims, 2 Drawing Sheets

GARMENT BAG WITH MOUNTING FOR HOOK

BACKGROUND OF THE INVENTION

This invention relates to a fabric garment bag and particularly to the mounting for the hook by which the garment bag is hung.

The garment bag has a rigid strap across its upper end. A hook is connected to the center of that strap for hanging the garment bag when it is in an unfolded state. In transport, when the garment bag is filled with clothes, it is customary to fold the garment bag upon itself. Side snaps are usually provided to hold the garment bag in the folded condition. The hook attached to the upper end is extended over to the lower end and passed through a small retaining loop attached to the bottom end. The retaining loop thus provides a place to hold the hook from swinging about and the attachment of the hook to the loop assists in maintaining the garment bag in its folded condition.

When very full of garments, the upper and lower ends tend to bulge. When brought together, in the folded state, the "throw," that distance from the upper end to the retaining loop on the lower end, to be spanned by the hook, needs to be about 9 inches. When lightly packed, the throw is about half that or 4½ inches.

SUMMARY OF THE INVENTION

It has been an objective of the present invention to provide, in a garment bag, a hook that selectively has a long throw to span the adjacent ends of a fully packed bag or a short throw to span the adjacent ends of a lightly packed bag.

The objective of the invention is attained by connecting the hook to a slide having an opening. A loop, about 4½ inches long, passes through the slide and is fixed to the rigid strap on the top of the garment bag. This combination provides a long throw for a fully packed bag. A rigid receptacle is fixed to the rigid strap and is adapted to mate with the slide so that the slide can be slid down the loop and captured in the rigid receptacle. This relationship or combination provides a short throw for a lightly packed bag.

BRIEF DESCRIPTION OF THE DRAWINGS

The objectives of the present invention will become more readily apparent from the followed detailed description taken in conjunction with the accompanying drawings in which.

DETAILED DESCRIPTION OF THE INVENTION

Figure 1:
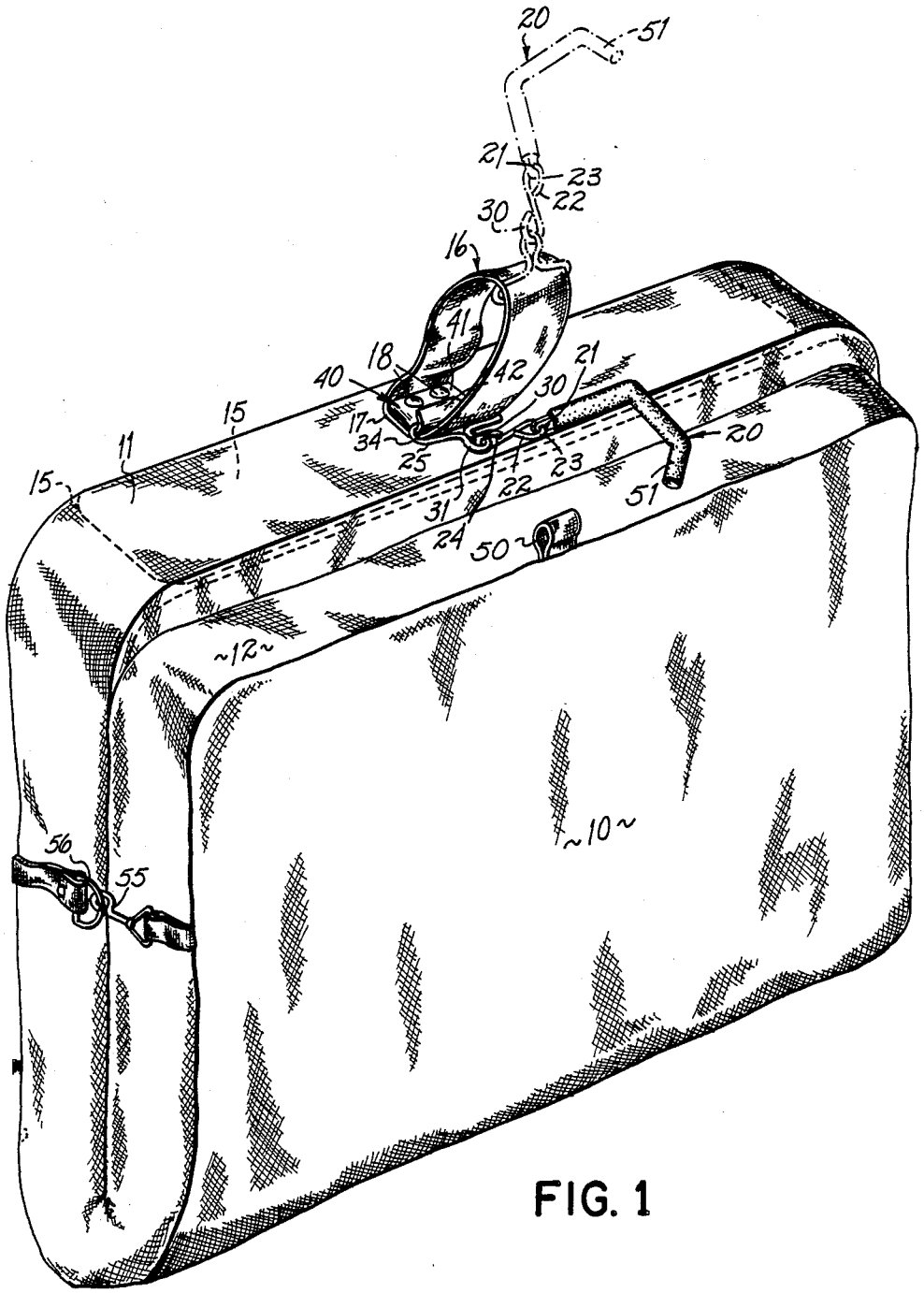
FIG. 1 is a perspective view of a garment bag having the present invention.

Referring to the drawings, a garment bag 10 has an upper end 11 and a lower end 12. The upper end is spanned by a rigid plastic or metal strap 15. A loop 16 of flexible webbing material has its overlapped ends 17 attached by rivets 18 to the rigid strap 15. A hook 20 has an eyelet 21 at its lower end. A link 22 has one end 23 passing through the eyelet. The other end 24 is connected to a slide 25. The slide has an opening 30 which is T-shaped. The stem portion 31 of the opening 30 receives the end 24 of the link 22. The opening 30 has a cross portion which receives the strap 16.

Lying across the overlapped ends of the strap 16 is a receptacle 40. The receptacle is J-shaped in cross section and has a flat plate portion 41 secured by the rivets 18 across the overlapped ends of the loop 16. The receptacle also has a lip 42 which mates with or receives the rod-like end 34 of the slide 25. The hook 20 can thus be attached to the strap 15 on the upper end of the bag by connecting it just to the loop as shown in phantom lines in FIG. 1 or by connecting the slide to the receptacle 40 as shown in full lines in FIG. 1.

The lower end of the bag 10 has a retaining loop 50 secured to it. The retaining loop is adapted to receive and frictionally retain the free end 51 of the hook 20. When the free end 51 of the hook 20 is inserted in the loop 50, the hook is retained free from flopping about and it serves to hold the lower end of the bag snugly against the upper end of the bag. On each side of the bag, a snap 55 and snap ring 56 are connected to the lower end portion and upper end portion of the bag, respectively, to provide the primary locking of the lower end to the upper end.

Figure 2:
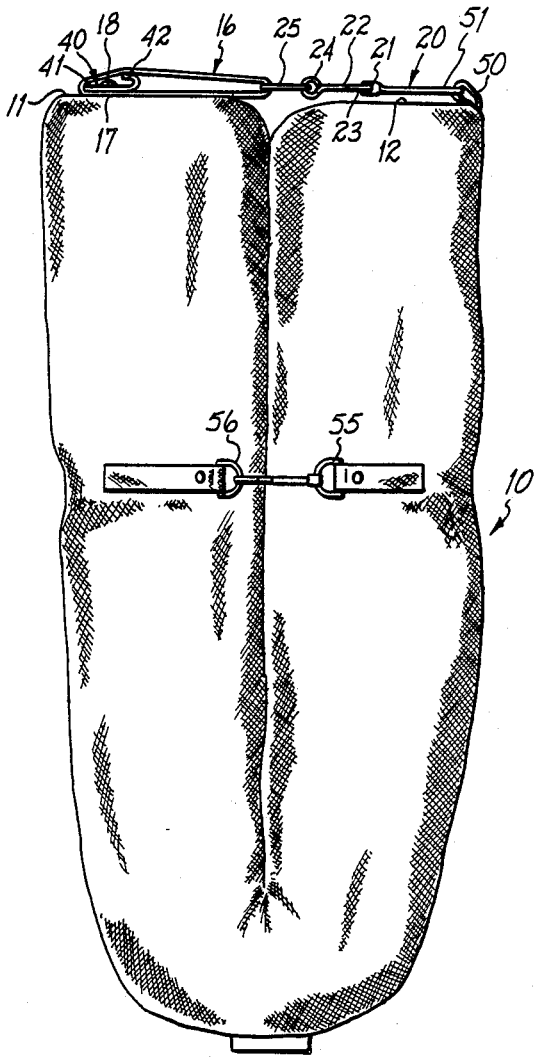
FIG. 2 is a side-elevational view of a fully packed, bag.

When the bag is quite full, as shown in FIG. 2, the loop 50 is forced by the garments in the bag to extend a substantial distance (e.g., 9 inches) from the center of the strap 15 to which the hook 20 is attached. In that condition, it is preferred that the slide be slid to the end of the loop 16 so that the throw of the hook is the combined loop 16, slide 25, link 24 and hook 20.

Figure 3:
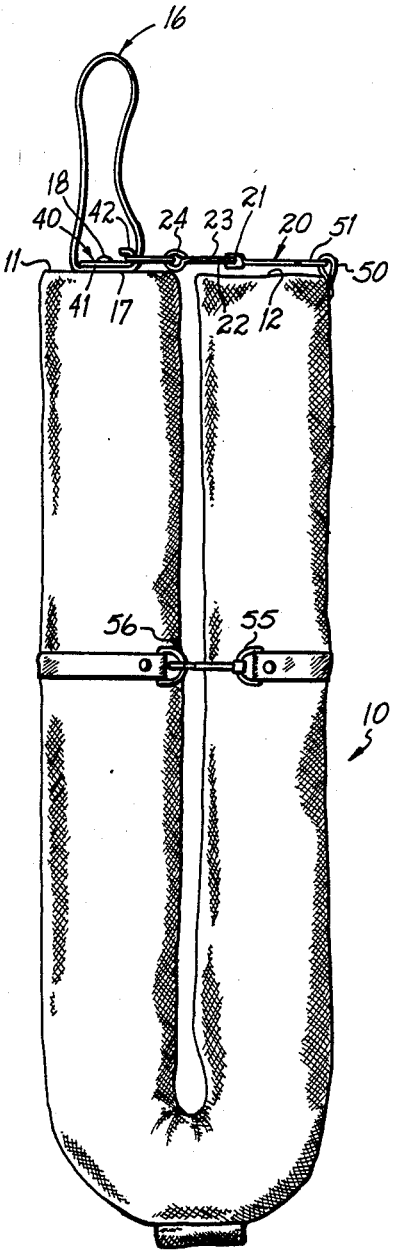
FIG. 3 is a side-elevational view of a lightly packed bag.

When the bag is lightly filled, it is not possible to make a snug fastening of the upper end to the lower end with that combination of loop 16 and hook 20. For that condition, as shown in FIG. 3, the slide is connected to the lip 42 of the receptacle 40. In this condition, the throw is about half the length of the loop and hook combination so that even with a lightly filled bag the connection across the bag can be snug.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A garment bag comprising:

an elongated fabric bag having an upper end and a lower end, a rigid elongated strap at said upper end and a retaining loop at said lower end, a rigid receptacle fixed to the center of said strap on the upper surface of said strap, a flexible loop fixed to the upper surface of said strap and surrounding said receptacle, a slide bar having an opening through which said flexible loop passes, means on said slide bar for mating with said receptacle to attach said slide bar to said receptacle, and a hook attached to said slide bar, whereby said hook can be attached close to said strap on said receptacle to provide a short throw to said retaining loop for a lightly packed bag or remote from said strap on said flexible loop for a long throw to said retaining loop for a fully packed bag.

2. A garment bag as in claim 1 in which:

said rigid receptacle is J-shaped in cross section having a long plate fixed to said strap and a retaining lip at the end of said plate, said slide bar opening being a T-shaped opening presenting a stem portion and a cross portion, a link connecting said hook to said stem portion, said cross portion receiving said flexible loop and said receptacle lip.

3. A garment bag comprising:

an elongated fabric bag having an upper end and a lower end, a retaining loop fixed to said lower end, an elongated rigid strap fixed to said upper end, a flexible loop of webbing having overlapping ends lying on the center of said strap, a J-shaped receptacle having a plate overlying said overlapped ends and rivetted through said loop ends to said strap, said plate having a lip on the edge of said plate nearest said lower end when said bag is folded upon itself, a slide having a T-shaped opening presenting a stem portion and a cross portion, the slide having a rod-like member defining said cross portion, said flexible loop received in the cross portion of said opening, a hook connected through the stem portion of said slide opening, the rod-like member being captured in said lip to provide a short throw of said hook to said retaining loop when said bag is lightly filled, said slide being at the end of said flexible loop remote from its ends to provide a long throw of said hook to said retaining loop when said bag is fully packed.

* * * * *